US006099265A

United States Patent [19]

Rowe, Jr. et al.

[11] Patent Number: 6,099,265

[45] Date of Patent: Aug. 8, 2000

[54] MACHINE WITH AT LEAST TWO MODES OF OPERATION AND SWITCHING MEANS FOR CHANGING THE MACHINE MODE OF OPERATION

[75] Inventors: David F. Rowe, Jr., Advance; William R. Hutchinson, Clemmons; Donald J. Myers, Lexington, all of N.C.

[73] Assignee: Ingersoll-Rand Company, Woodcliffe Lake, N.J.

[21] Appl. No.: 09/152,982

[22] Filed: Sep. 14, 1998

Related U.S. Application Data

[60] Provisional application No. 60/059,019, Sep. 16, 1997.

[51] Int. Cl.[7] ..... F02B 63/04; F02B 63/06

[52] U.S. Cl. ..... 417/313; 290/1 A

[58] Field of Search ..... 417/313; 290/1 A

[56] References Cited

U.S. PATENT DOCUMENTS

| | | | |
|---|---|---|---|
| 1,663,530 | 3/1928 | Metzgar | 417/313 |
| 2,364,013 | 11/1944 | Waseige | 290/1 A |
| 2,733,661 | 2/1956 | Surgi | 417/234 |
| 3,497,133 | 2/1970 | Childress et al. | 417/313 |
| 3,514,219 | 5/1970 | Mitchell et al. | 417/53 |
| 4,173,951 | 11/1979 | Ishihara | 123/2 |
| 4,293,281 | 10/1981 | Lamoreaux | 417/9 |
| 5,087,824 | 2/1992 | Nelson | 290/1 A |
| 5,341,644 | 8/1994 | Nelson | 60/627 |
| 5,497,742 | 3/1996 | Plantan | 123/197.5 |

FOREIGN PATENT DOCUMENTS

| | | |
|---|---|---|
| 0 495 760 A2 | 7/1992 | European Pat. Off. . |
| 2 331 424 | 6/1997 | France . |
| 3132764 | 5/1983 | Germany . |

*Primary Examiner*—Andrew M. Dolinar

[57] ABSTRACT

A machine including a fluid compressor; a generator; a prime mover operably connected to the compressor and the generator; a machine switching means for switching the machine to a first mode of machine operation where only the compressor is operable, to a second mode of machine operation where only the generator is operable, to third mode of machine operation where neither the compressor nor the generator are operable, or to a fourth mode of machine operation where both the compressor and generator are operable.

6 Claims, 1 Drawing Sheet

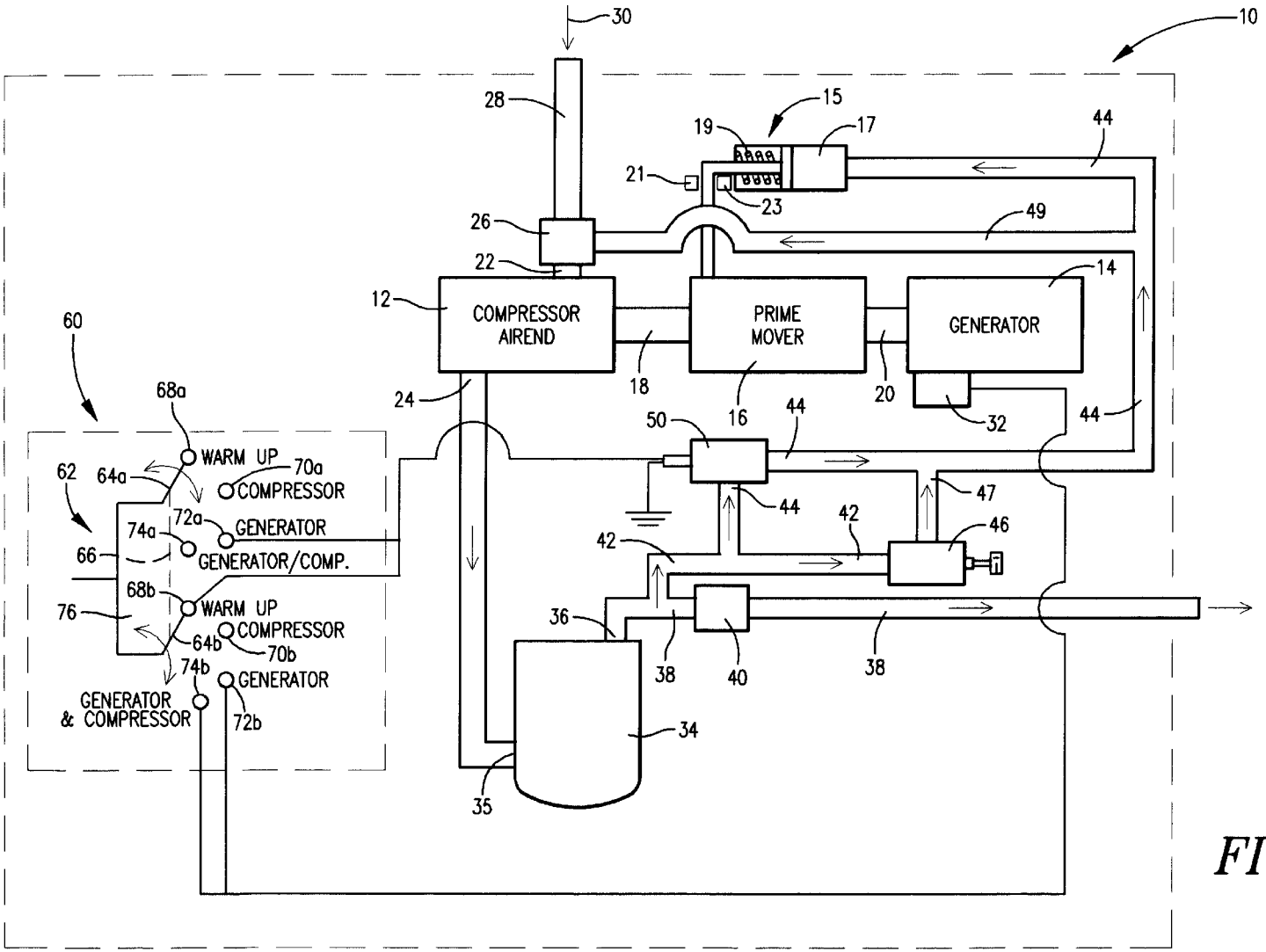
FIGURE

MACHINE WITH AT LEAST TWO MODES OF OPERATION AND SWITCHING MEANS FOR CHANGING THE MACHINE MODE OF OPERATION

This application claims the benefit under 35 U.S.C. 119(e) of U.S. provisional application Ser. No. 60/059,019 filed Sep. 16, 1997.

BACKGROUND OF THE INVENTION

The invention relates to a machine that has at least two modes of operation, and more particularly the invention relates to a machine that has at least two modes of operation and the machine includes switching means for changing the machine mode of operation.

Portable machines which include a generator for supplying electric power and a compressor for supplying pressurized fluid are transported on a vehicle such as a truck to a job site where the requisite electrical power and/or compressed fluid are not readily available.

The generator and compressor are driven by a common engine or prime mover. Electrical alternating current (AC) power generators available for use in such portable machines are subject to variations in voltage and frequency as engine speed changes. The change in engine speed is caused by an engine speed regulating system which adjusts the engine speed throttle to match the air compressor power demand. As the compressor power demand decreases, the engine speed is decreased by the throttle. The decrease in prime mover speed is in most applications viewed as an advantage because the decreasing the engine speed results in lower air usage, a savings in fuel consumption, reduction in noise emitted by the machine, and an increase in the machine useful life. However, the engine speed fluctuation is unacceptable for many applications such as fusion welding machines for plastic pipe, which require steady voltage and frequency from the AC power generator, thus requiring steady engine speed.

Running the engine at full speed is an acceptable way to reduce the number of speed variations as the engine is loaded and unloaded by the air compressor and generator demands. However there are a few limitations associated with running the engine at full speed, including increased engine fuel consumption, increased machine noise, and decreased engine life.

Engine governors are often used to maintain engine at constant speed as engine power demand changes. One notable limitation associated with use of engine governors are engine speed overshoot and undershoot from the governed speed as engine power demand is changed suddenly.

Operator training has been used to teach users to avoid using pressurized air during certain applications that require steady generator frequency and voltage. Some limitations associated with this technique include accidental or intentional operation of the service valves, accidental or intentional operation of air driven tools such as jackhammers, and sudden loss of hose integrity due to the activation of hose quick disconnects, cut or damaged hoses.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a machine with at least two modes of operation and switching means for changing to the desired machine mode of operation.

In another aspect of the present invention the machine has a fluid compressor, and a generator driven by a common prime mover. The machine has four modes of operation: a warm up mode used when the machine is started, a compressor mode used when only compressed air is needed by the machine operator, a generator mode when only electricity is needed by the machine operator, and a generator and compressor mode when both compressed fluid and electricity are needed by the operator. A two contact, four-way switch is used to change the machine to one of the four modes of operation.

The foregoing and other aspects will become apparent from the following detailed description of the invention when considered in conjunction with the accompanying drawing figure.

DESCRIPTION OF THE DRAWING FIGURE

The FIGURE is a schematic representation of a machine that has a number of different modes of operation and includes switching means for changing the mode of operation for the machine.

DESCRIPTION OF THE PREFERRED EMBODIMENT

Turning now to the FIGURE wherein like parts are referred to by the same number in the FIGURE, machine 10 as schematically represented in the FIGURE includes fluid compressor 12 and generator 14 that are directly driven by prime mover 16 through respective conventional couplings or gears 18 and 20. The machine 10 has four modes of operation: a first mode of machine operation also referred to as a compressor mode, where only the compressor is operable; a second mode of machine operation also referred to as a generator mode where only the generator is operable; a third mode of machine operation also referred to as a warm up mode used when the machine 10 is started and neither the compressor nor the generator are operable, and a fourth mode of machine operation also referred to as a generator/compressor mode where the compressor and generator are operable. The machine operator may change to the required mode of machine operation by switching means 60 in the manner that will be described in greater detail below. By the switching means 60, the shortcomings associated with prior art portable machines are eliminated.

The compressor is preferably a well known conventional compression module or airend with interengaging rotors that rotate about parallel longitudinal axes. The compressor includes an inlet 22 through which ambient fluid such as air enters the compressor, and an outlet 24 through which compressed fluid is discharged from the compressor. An inlet valve 26 is flow connected to the compressor inlet 22 and serves to regulate the volume of ambient fluid supplied to the compressor. The inlet valve 26 may be any well known inlet valve such as a butterfly type valve for example. Ambient fluid is drawn into the compressor in the direction of arrow 30, through inlet conduit 28.

Prime mover 16 may be any conventional internal combustion engine or diesel engine that is adapted to drive both compressor 12 and generator 14. The change in engine speed is caused by an engine speed throttle 15 which adjusts the engine speed throttle to match air compressor demand. The throttle is a pneumatic cylinder 17 that acts against a spring biased throttle handle 19 that is movable between idle speed adjustment stop member 21 and full speed stop member 23.

The throttle handle 19 is pivotally connected to prime mover 16. The throttle pneumatic cylinder 17 is flow connected to the compressed fluid supply lines and is supplied with a volume of compressed fluid during operation of fluid compressor 12. The throttle is spring loaded to the engine full speed position 23 however as the pressure in the cylinder increases the cylinder 17 drives the throttle to the idle position 21. If the prime mover 16 is a gasoline engine, the air supplied to the engine is adjusted by the throttle. In the preferred embodiment of the invention, the prime mover is a diesel engine and the fuel supplied to the prime mover is adjusted by the throttle.

Generator 14 is a conventional auxiliary AC type generator well known to one skilled in the art. The generator includes an externally located generator control box 32, electrically connected to the generator components.

The compressor outlet 24 is flow connected to separator tank 34. A mixture comprised of compressed fluid and undesirable liquid and particulate matter entrained in the compressed fluid stream during compression is flowed to the separator through separator inlet 35. The separator tank stores a volume of compressed fluid and uses conventional filter means to separate any undesirable liquid and particulate matter entrained with the compressed fluid so that substantially liquid and particulate free compressed fluid is discharged from the separator tank discharge 36 and through discharge conduit 38 to a pneumatically actuated object of interest such as a jackhammer or impact wrench for example. Minimum pressure in the separator tank 34 is maintained by a conventional minimum pressure valve 40 in discharge conduit 38. The minimum pressure valve is a spring loaded valve that closes below a predetermined threshold minimum separator tank pressure, typically 70 pounds per square inch (psi) in this way, a pressure of at least 70 psi is maintained in the separator tank.

Discharge conduit branch 42 is connected to discharge conduit 38 between the minimum pressure valve 40 and separator tank discharge 36. Branch 44 is flow connected to branch 42 between the branch inlet and pressure regulator 46 which is flow connected to one end of discharge conduit branch 42 as shown in the FIGURE.

Branch 44 flow connects the branch 42 to throttle 15 and inlet valve supply branch 49 as illustrated in the FIGURE. During operation of machine compressor 12, when the fluid pressure increases to a predetermined maximum pressure at the location where conduit 49 is connected to inlet valve 26, the inlet control valve will close shutting off the air flow to the compressor.

The pressure regulator 46 is a conventional pressure regulator and alters the pressure of the compressed fluid delivered out the regulator to regulator branch 47 in response to the pressure of the pressurized fluid flowed out of separator tank 34 and supplied to pressure regulator through conduit 42.

Start-run electronically actuated solenoid 50 is located in conduit 44. The valve is typically closed and opens when a voltage is supplied to the solenoid. When opened, the valve provides a flow path for pressurized fluid to the engine speed control cylinder 17 to cause the engine to remain at idle.

The start-run solenoid 50 and generator control box 32 are electrically connected to switching means 60 that permits the machine operator to effectively change the machine mode of operation. As indicated above the machine as disclosed for purposes of describing the preferred embodiment of the invention has four modes of operation however, it should be understood that the inventors contemplate a machine generally having at least two modes of operation.

Switching means 60 includes four-way switch 62 with two sets of contacts 64*a* and 64*b* that are connected by link 66 so that movement of either contact 64*a* or 64*b* causes the opposite contact to also be pivoted to the desired mode of machine operation. The contacts are movable to one of four switch positions, warmup mode position 68*a,b*; compressor only mode position 70*a,b*; generator only mode position 72*a,b*; or compressor and generator mode position 74*a,b*. Switch positions 72*b* and 74*b* are electrically connected to the generator control box 32, so that when contact 64*b* is moved to generator only mode 72*b* or compressor and generator mode position 74*b*, the generator is powered by the switching means voltage supply 76.

The generator and compressor mode position 74*a*, generator only mode position 72*a*, and warm up mode position 68*b* are electrically connected to start-run solenoid 50 so that when the contact 64*b* is switched to position 68*b*, or contact 64*a* is switched to position 72*a* or 74*a*, the voltage supply 76 provides the voltage required to open the solenoid 50 and permit pressurized air to pass from separator 34 to throttle 15.

Operation of the machine 10 and switching means 60 will now be described. When the machine is started and the switch 62 is in warm up mode position 68*a,b,* the generator and compressor are not operable. A voltage is supplied to solenoid 50 opening the solenoid. As a result, pressurized air is supplied from the separator tank 34 to the engine speed control cylinder 17 to hold the prime mover in idle during warm up.

When the switch contacts 64*a,b* are in the generator mode position 72*a,b,* voltage from the battery 76 is delivered to the generator control box 32 and the voltage activates the generator. The control box activates the generator when voltage is delivered to the control box, and thereby allows the generator to be switched on or off as required. Simultaneously, voltage is delivered to the electrical start-run solenoid valve 50 causing it to open and allow pressurized fluid to be diverted past the pressure regulator and delivered directly to the engine speed control cylinder 17. The pressure generates a force against the spring and moves the engine throttle from full speed position 23 to idle stop member 21. Air is simultaneously delivered to the inlet control valve 26 which closes when the pressure exceeds a predetermined maximum, closing the inlet flow. The pressure build up at the inlet greatly reduces the horsepower required to drive the compressor when it is actuated.

When the switch contacts 64*a,b* are moved to the compressor only mode position 70*a,b,* the solenoid valve 50 and generator control 32 are deactivated. The solenoid closes and the air pressure to the engine speed control cylinder must pass through pressure regulator 46. This is normal operating condition for an engine driven air compressor and the pressure regulator allows the air compressor to produce air and adjusts engine speed according to demand.

When the contacts 64*a,b* are in generator and compressor mode position 74*a,b,* the generator is activated as previously described in relation to generator only mode and the compressor produces compressed fluid to be supplied through the discharge conduit in the manner described in compressor only mode.

By the present machine and switching means fluctuations in power supply to the generator are eliminated by switching the machine to the desired mode of operation.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. A machine comprising: a fluid compressor operable during a first mode of machine operation; a generator operable during a second mode of machine operation; a prime mover operably connected to the compressor and the generator; and means for switching the machine to the first mode of machine operation where only the compressor is operable and to the second mode of machine operation where only the generator is operable, the switching means being comprised of a four position switch with two independent sets of contacts.

2. The machine as claimed in claim 1 wherein the machine further includes a third mode of machine operation where neither the generator nor the compressor are operable and means for switching the machine to the third mode of machine operation.

3. The machine as claimed in claim 1 wherein the machine further includes a third mode of machine operation where both the generator and the compressor are operable and means for switching the machine to the third mode of machine operation.

4. The machine as claimed in claim 3 wherein the machine further includes a fourth mode of machine operation where neither the generator nor the compressor are operable and means for switching the machine to the fourth mode of machine operation.

5. The machine as claimed in claim 2 wherein the third mode of operation is a warm up mode of machine operation.

6. A machine having at least four modes of operation, the machine comprising: a fluid compressor; a generator; a prime mover operably connected to the compressor and the generator; and means for switching the machine to a first mode of machine operation where only the compressor is operable, to a second mode of machine operation where only the generator is operable, to third mode of machine operation where neither the compressor nor the generator are operable, or to a fourth mode of machine operation where both the compressor and generator are operable, and wherein the means for switching machine operating modes is comprised of a four-way switch.

* * * * *